United States Patent [19]

Tiggelers et al.

[11] 4,051,986

[45] Oct. 4, 1977

[54] PHOTOCONDUCTOR STORING APPARATUS

[75] Inventors: Hubertus H. Tiggelers, Venlo; Martinus P. Chlôd, Velden, both of Netherlands

[73] Assignee: Pitney-Bowes, Inc., Stamford, Conn.

[21] Appl. No.: 673,006

[22] Filed: Apr. 2, 1976

[30] Foreign Application Priority Data

June 6, 1975 Netherlands ..... 7506724

[51] Int. Cl.[2] ..... B65H 17/42

[52] U.S. Cl. ..... 226/114; 226/118; 270/61 F

[58] Field of Search ..... 226/113, 114, 118, 119; 270/61 F, 79

[56] References Cited

U.S. PATENT DOCUMENTS

| | | | |
|---|---|---|---|
| 3,756,488 | 9/1973 | Van Megen | 226/119 |
| 3,836,138 | 9/1974 | Klepper | 270/61 F X |
| B. 481,048 | 3/1976 | Toto | 226/119 X |

*Primary Examiner*—Richard A. Schacher
*Attorney, Agent, or Firm*—Donald P. Walker; William D. Soltow, Jr.; Albert W. Scribner

[57] ABSTRACT

In a copier including a photoconductor comprising a web of photoconductive material, having a plurality of photoconductive sections connected in series with one another to form an endless strip-type photoconductor, and including suitable instrumentalities for successively feeding the photoconductive sections from a zigzag folded stack of such sections through several processing stations and back to the stack, there is provided apparatus for storing the photoconductive sections in the stack. The storing apparatus includes a receptacle having oppositely disposed walls defining an inlet opening and an outlet opening. The walls relatively converge towards one another from the inlet opening to the outlet opening, for guiding the folds of the photoconductive sections progressively closer to the outlet opening than the mid-portions thereof in transit through the receptacle. A pair of tamping devices, movably mounted on the opposite receptacle walls, cooperate with the receptacle walls for guiding incoming photoconductive sections toward the stack. In addition, apparatus is provided for moving the tamping devices out of step with one another toward and away from the stack, including for example, a pair of pivotally mounted and spring-loaded carriers adapted to slidaly engage the tamping devices during only a portion of the movement thereof so as to spring-urge each of the tamping devices into sliding engagement with the receptacle wall associated with the same during said portion of movement.

9 Claims, 4 Drawing Figures

PHOTOCONDUCTOR STORING APPARATUS

BACKGROUND OF THE INVENTION

Electrostatic copiers provided with photoconductors of the type which comprise a web of photoconductive material including a plurality of photoconductive sections connected in series with one another so as to form an endless strip-like photoconductor, have been provided with suitable means for serially feeding the photoconductive sections from the bottom of a zigzag folded stack of such sections, at a storage station, through several processing stations and then to the top of the stack.

As disclosed in U.S. Pat. No. 3,756,488 issued Sept. 4, 1973 to Van Megen et al.; at the storage station of one known copier there has been provided apparatus for storing the photoconductive sections which includes an elongated receptacle having a generally U-shaped transverse cross-section formed by a pair of oppositely disposed walls. The walls define an upper inlet opening through which processed photoconductive sections are successively fed to the top of the stack, and a lower outlet opening through which stroed photoconductive sections are successively fed from the bottom of the stack. The receptacle walls extend convergently toward one another from the inlet opening to the outlet opening so as to cause the photoconductive sections to bow upwardly within the receptacle. Thus the folds of the photoconductive sections move progressively closer to the outlet opening than the mid-portions thereof as the sections move downwardly through the receptacle. The stack of photoconductive sections is bowed upwardly within the receptacle to facilitate feeding the sections from the bottom of the stack. The photoconductor storing apparatus also includes a pair of tamping devices, slidably attached to the opposite receptacle walls, and a pair of suitably driven rocker arms arranged to altenately lift the tamping devices and allow them to fall under the influence of gravity against the opposite folds of the photoconductive sections as they are fed to the top of the stack. The tamping devices thus cooperate with the receptacle walls in guiding the folds of the photoconductive sections below the level of their respective mid-portions.

As disclosed in U.S. patent application Ser. No. 481,048, filed June 20, 1974 and respecting which confidentiallity was waived by the assignee to permit inclusion of the application in the second Trial Voluntary Protest Program of the United States Patent and Trademark Office; in the above described storing apparatus the photoconductive sections tend to resist being upwardly bowed due to the stiffness of the photoconductor. The forces exerted upwardly on the tamping devices often prevent the same from sliding as far downwardly on the receptable walls as is permitted by the rocker arms, as a result of which the tamping devices become disassociated from the rocker arms. The arms may therefore become cocked in place on the receptacle walls or situated as close to the inlet opening that they interfere with the passage of the folds of incoming photoconductive sections. To cure the problem, the aforesaid application disclosed improved storing apparatus for moving the tamping devices out of step with one another toward and away from the stack including means for resiliently interconnecting the rocker arms to the tamping devices.

In the present application there is disclosed a different arrangement of apparatus, than is disclosed in the aforesaid U.S. patent application, for curing the problem discussed in that application for promoting longevity of the photoconductor and resilient means. Accordingly:

An object of the present invention is to provide improved apparatus for storing photoconductive sections in a zig-zag folded stack in a receptacle at the storage station of an electrostatic copier.

Summary of the Invention

In a receptacle for a stack of zig-zag folded photoconductive web material having an imaging plane, conveying means for removing the web under traction via an outlet opening from the receptacle and for supplying the web material to an inlet opening of the receptacle, the receptable having guide walls arranged such that the stack is guided through the receptacle so as to cause the web portions situated in closer proximity to the outlet opening than the inlet opening to take the form of an arc which is concave-side oriented toward the outlet opening, whereby the stack is bowed; tamping assemblies respectively movably mounted an opposite guide walls for contacting the folds of the web portions of the stack; and driving means for reciprocating the respective tamping assemblies along the guide walls; the improvement comprising: means for intermittently interconnecting the driving means and tamping assemblies, said interconnecting means including means for resiliently urging the tamping assemblies into sliding engagement with the guide walls.

BRIEF DESCRIPTION OF THE DRAWINGS

As shown in the drawings, wherein like reference numerals designate like or corresponding parts throughout the several Figures.

DESCRIPTION OF THE PREFERRED EMBODIMENT

Figure 1:
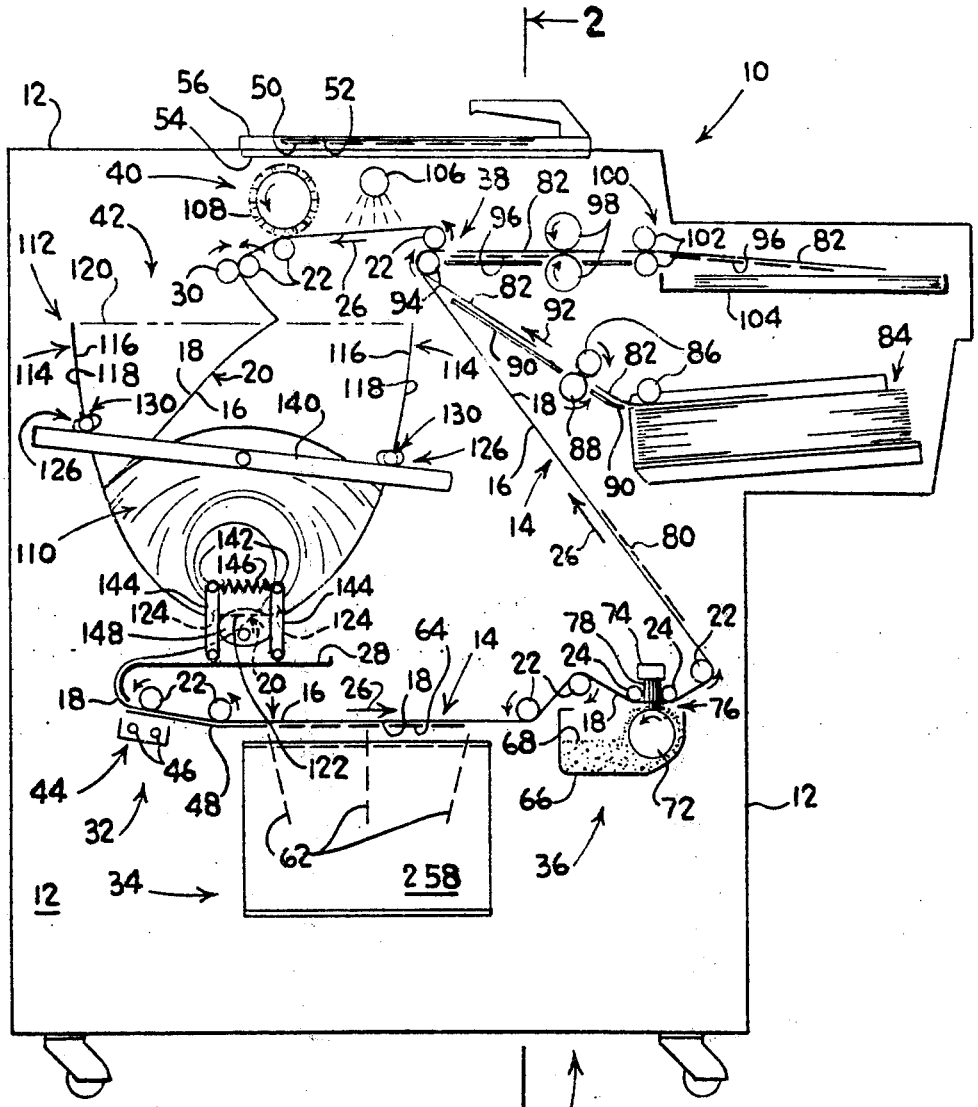
FIG. 1 is a schematic diagram, in elevation, of an electrostatic copier including a strip-type photoconductor having a plurality of series connected photoconductive sections folded on top of one another in a zig-zag folded stack, and including prior art apparatus for storing the photoconductive sections in the stack.

As shown in FIG. 1, an electrostatic copier 10, of the type which may be improved in accordance with the present invention, generally includes suitable framework 12 for supporting the various components of the copier 10, including a photoconductor 14. The photoconductor 14 is made of a suitable strip of relatively stiff foldable material, having an inner surface 16 and an outer surface 18. The outer surface 18 is coated with a suitable photoconductive powder such as an oxide of zinc dispersed in a suitable binder either along or in combination with a suitable plasticizer and a suitable dye sensitizer for extending the light sensitivity of the coating. And, the photoconductor 14 is divided into a plurality of photoconductive sections 20 of suitable length for folding purposes.

To movably support the photoconductor 14 (FIG. 1) within the copier 10, the copier 10 includes a plurality of elongated rotatable idler rollers 22, about which the photoconductor 14 is suitably endlessly looped, and a plurality elongated guide rollers 24. The rollers 22 and 24 are disposed parallel to one another and suitably secured to the framework 12 so as to longitudinally extend transverse to a desired path of travel 26 of the moving photoconductor 14. In addition, the copier 10 includes a guide plate 28 and a suitably driven elongated rotatable shaft 30. The driven shaft 30 is suitably secured to the framework 12 so as to extend parallel to the respective rollers 22 and rotate in engagement with the other surface 18 of the photoconductor 14, for moving the photoconductor 14 in the aforesaid path of travel 26 from the guide plate 28 past a charging station 32, imaging station 34, developing station 36, transferring station 38 and cleaning station 40, to a storage station 42.

At the charging station 32 (FIG. 1), the copier 10 includes a suitably electrically energizeable corona charging device 44 including a pair of elongated, high-voltage, charging electrodes 46, suitably spaced from the moving photoconductor 14 and oriented relative to the same so as to longitudinally extend transverse to the photoconductor's path of travel 26, for depositing a uniformly distributed array of electrostatic charges 48 of suitable polarity on the photoconductor's outer surface 18.

Figure 2:
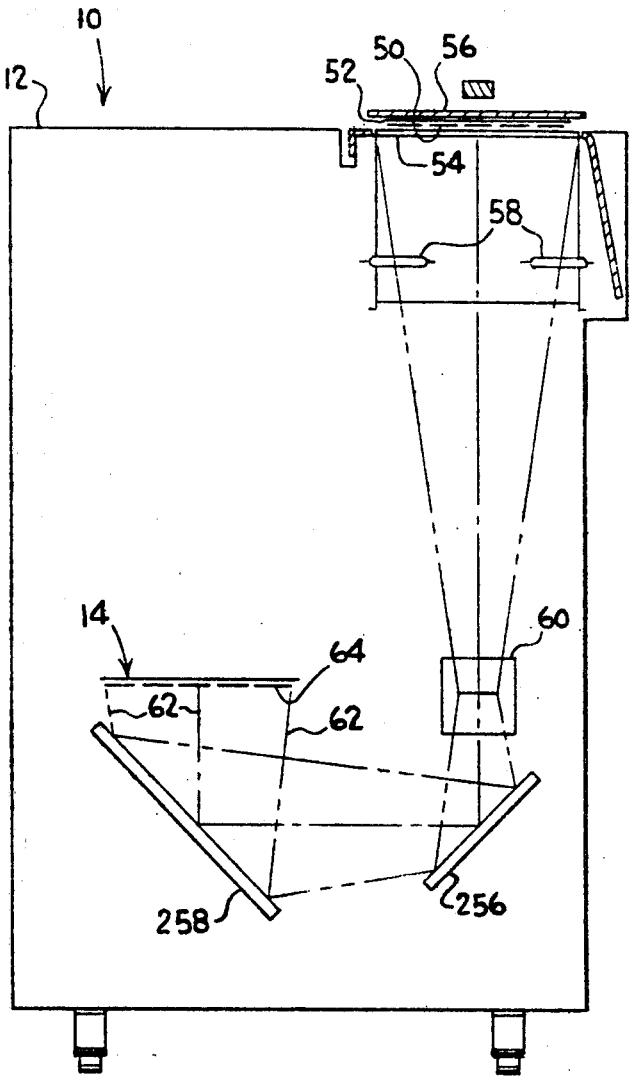
FIG. 2 is a cross-sectional, right side view, in elevation, of the electrostatic copier of FIG. 1, taken substantially along the line 2—2 thereof, showing a schematic diagram of the photoconductor imaging apparatus of the copier.

At the imaging station 34 the copier 10 includes means for providing the photoconductor 14 with information in the form of a graphic image 50 (FIG. 2) carried by a document 52 placed by the operator on a glass platen 54 secured to the copier's framework 12 beneath a cover 56. To that end, the copier 10 includes one or more electrically energizable light sources 58, mirrors 256 and 258 and a lens 60 adapted by well-known means to cooperate with one another for illuminating the document 52 and flash exposing the photoconductor 14 with light 62 modulated by the graphic-image 50. The graphic-image modulated light 62 (FIG. 1) from the mirror 258 causes the photoconductor 14 to conduct and dissipate sufficient charge 48 from the photoconductor's outer surface 18 to provide the same with a developable electrostatic latent image 64.

At the developing station 36 (FIG. 1) the copier 10 includes a container 66 for locally holding a resuable supply of developing material 68, and developer material transporting means including a suitably driven elongated rotatable shaft 72 and an elongated permanent magnet 74, magnetically coupled to one another. The magnet 74 and shaft 72 are located on opposite sides of the photoconductor 14 and suitably secured to the framework 12 so as to longitudinally extend parallel to one another, out of contact with the moving photoconductor 14 and transverse to the photoconductor's path of travel 26. The rotating shaft 72 carries developer material 68 from the container 66 into a suitably narrow space 76 between the shaft 72 and photoconductor surface 18, wherein the magnetic field 78 of the magnet 74 brings carried developer material 68 into contact with the moving photoconductor 14. As a result, some of the toner material of the carried developer material 68 adheres to the electrostatic latent image 64 so as to render the image 64 visible; thereby forming a transferable, developed image 80 on the outer surface 18 of the moving photoconductor 14.

The developed image 80 (FIG. 1) is then transferred from the photoconductor surface 18 to a suitable supporting substratum, such as a sheet of paper 82. The paper 82 is fed to the transferring station 38 from a suitably supported paper stack 84 by means of a pair of suitably driven elongated rollers 86 cooperating with an elongated idler roller 88 and a pair of guide plates 90. The rollers 86 and 88 are oriented so as to longitudinally extend parallel to one another transverse to the path of travel 26 of the moving photoconductor 14, and are suitably secured to the framework 12 for rotation in engagement with successive sheets of paper 82, to move the same from the stack 84 in a desired path of travel 92 on the guide plates 90 to the transferring station 38.

At the transferring station 38 (FIG. 1) the copier 10 includes an elongated, rotatable, idler shaft 94 suitably secured to the framework 12 so as to longitudinally extend parallel to the respective paths of travel 26 and 92 of the moving photoconductor 14 and sheet of paper 82. The rotating shaft 94 is disposed in engagement with the moving sheet of paper 82 and in sufficiently close proximity to the moving photoconductor 14 to forceably urge the paper 82 into intimate engagement with the image-bearing outer surface 18 of the moving photoconductor 14 to form a developed graphic image 96 on the sheet of paper 82. Preferably the shaft 94 is electrically energized by well-known means to provide an electric field of suitable polarity between the shaft 94 and next adjacent roller 22, tending to aid in transferring toner from the developed image 80 to the paper 82.

The graphic image 96 (FIG. 1) is thereafter fused to the paper 82 through the application of heat to the image 96. To that end, the copier 10 includes an image bonding device such as a pair of suitably heated elongated rollers 98. The rollers 98 are disposed parallel to one another and suitably secured to the framework 12 so as to longitudinally extend transverse to the path of travel 92 of the moving, image-bearing sheet of paper 82. The rollers 98 are also suitably driven by well-known means in engagement with the sheet of paper 82 for feeding the bonded-image bearing paper 82 to a receiving station 100. At the receiving station 100 the copier 10 includes a pair of suitably driven paper feeding rollers 102 adapted by well-known means to engage and feed bonded-image bearing sheets of paper 82 to a suitable hopper 104 for retrieval by the operator of the copier 10.

After the developed image 80 (FIG. 1) is transferred to a sheet of paper 82, the moving photoconductor 14 is guided to the cleaning station 40 by the idler roller 22 next adjacent to the transfer roller 94. At the cleaning station 40 the copier 10 includes a lamp 106 and a suitably housed and driven rotating brush 108. The lamp 106 is suitably secured to the copier framework 12 and disposed in sufficiently close proximity to the outer surface 18 of the photoconductor 14 to irradiate the photoconductive coating thereon in order to remove residual charge 48 from the coating. The brush 108 is suitably secured to the framework 12 so as to longitudinally extend transverse to the path of travel 26 of the moving photoconductor 14 and rotate in engagement with the same for removing any developer material 68 from the photoconductor 14 which was not transferred therefrom to the sheet of paper 82. The cleaned photoconductor 14 is thereafter fed to the storage station 42.

At the storage station 42 (FIG. 1) the copier 10 includes apparatus for temporarily storing a plurality of the photoconductive sections 20 on top of one another in a zig-zag folded stack 110. In the prior art (FIGS. 1 and 3), the storing apparatus includes an elongated, open-ended receptacle 112 having a generally U-shaped transverse cross-section. The receptacle 112 includes a pair of oppositely spaced longitudinally-extending, curved, sheet metal side walls 114, each of which has an inner side surface 116 and an outer side surface 118. The side walls 114 are suitably secured to the copier framework 12 and form an upper inlet opening 120 and a lower outlet opening 122 (FIG. 3) through which the photoconductive sections 20 are respectively fed to and from the stack 110. The side walls 114 initially extend downwardly and slightly convergently toward one another from the inlet opening 120 and then extend further downwardly and more convergently toward one another, curving through a total angle of approximately 90°, to the outlet opening 122; and then extend upwardly and convergently toward another at an angle of approximately 45° from the horizontal, to form a pair of opposed lips 124 extending inwardly of the receptacle's outlet opening 122. The wall 114 (FIG. 1) thus extend relatively convergently towards one another from the inlet opening 120 to the outlet opening 122 for guiding the folds of the stacked photoconductive sections 20 progressively closer to the outlet opening 122 than the mid-portions thereof in transit through the receptacle 112; to facilitate feeding the photoconductive sections 20 from the bottom of the stack 110 through the outlet opening 122.

To urge the opposite folds of the stacked photoconductive sections 20 (FIG. 1) toward the receptacle outlet opening 122, the storing apparatus includes a pair of oppositely-spaced tamping assemblies 126 (FIGS. 1 and 3), slidably movably mounted on opposite receptacle walls 114. The tamping assemblies 126 each include a pair of horizontally-extending rods 128 (FIG. 3) located on opposite sides of the associated receptacle wall 114, and a pair of oppositely-spaced end caps 130 fixedly secured to the adjacent ends of the associated rods 128. The attached caps 130 each includes a yoke-like body portion 132 having a slot 134 for disposition of the caps 130 of a given tamping assembly 126 in reciprocating sliding engagement with the associated receptacle wall 114. In addition, the attached caps 130 each include a head portion 135 extending outwardly from the body portion 132 in the direction of the extension of the longitudinal lengths of the associated rods 128. And, the attached caps 130 each include a pair of flange portions 138 extending laterally from the body portion 132, in opposite directions, to restrict rotation of the sliding end caps 130 on the associated walls 114, and thus prevent excessive rotation of the sliding tamping assemblies 126 relative to the associated receptacle walls 114.

Figure 3:
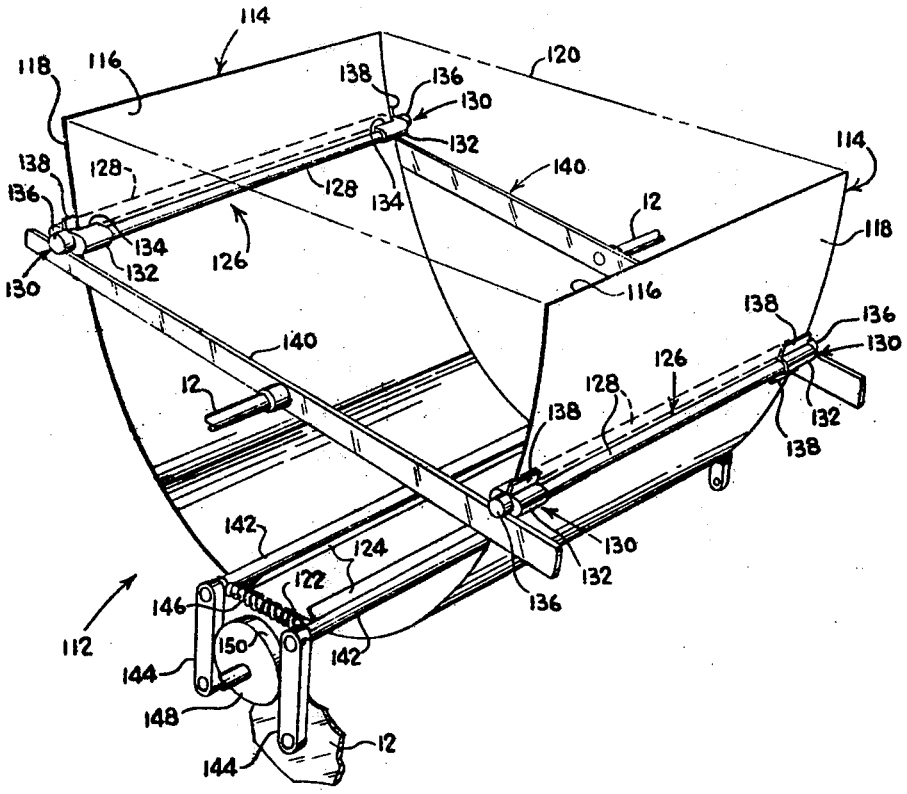
FIG. 3 is an enlarged, fragmentary perspective view of the prior art photoconductor storing apparatus of FIG. 1; and, FIG. 4 is a reduced, fragmentary left end view, in elevation of the apparatus of FIG. 3, modified in accordance with the present invention to include improved means for guiding photoconductive sections toward the fan-folded stack and improved means for intermittently resiliently urging the folds of the photoconductive sections below the respective midportions thereof during a portion of the transit time of the stack from the top to the bottom of the receptacle.

The tamping assemblies 126 (FIG. 1) are moved out of step with one another, in and out of contact with the stack 110, to alternately tamp the opposite folds of the stacked photoconductive sections 20 toward the receptacle outlet opening 122. To that end, the copier storing apparatus includes a pair of oppositely spaced, suitably driven, elongated rocker arms 140 (FIGS. 1 and 3) extending across the opposite open ends of the receptacle 112 (FIG. 3). The arms 140 are suitably pivoted to the copier framework 12, approximately midway between their respective ends, and rocked in step with one another, clockwise and then counter-clockwise, above and below the horizontal and thus alternately toward and away from the stack 110 (FIG. 1) and receptacle outlet opening 122.

To facilitate feeding the stacked photoconductive sectons 20 (FIG. 1) one at a time from the bottom of the stack 110, the storing apparatus also includes a pair of elongated, oppositely-spaced, parallel rods 142 (FIG. 3) extending lengthwise through the receptacle 112. And, at each end of the receptacle 112, suitable means are provided for horizontally reciprocating the rods 142, sidewise, within the receptacle 112 including a pair of oppositely-spaced links 144, an elongated tension spring 146 and a cam 148 having an outer surface 150. At each end of the receptacle 112, the links 144 are respectively suitably pivoted to and extend from the copier framework 12 to opposite rods 142; the spring 146 is attached to and extends between the rods 142 for holding the links in bearing engagement against the outer surface 150 of the cam 148; and the suitably driven cam 148 is attached to the copier framework 12 for rotation in bearing engagement with the links 144. The cam outer surfaces 150 are respectively suitably shaped to alternately pivot the links 144 relative to the copier framework 12, to reciprocate the rods 140 toward and away from the receptacle walls 114 for alternately holding and releasing the opposite folds of the photoconductive sections 20 at the receptacle lips 124. The drive (not shown) for the cams 148 and rocker arms 140 is controlled by well-known means to ensure horizontal reciprocation of the rods 142 in timed relationship with the vertical reciprocation of the tamping assemblies 126, to synchronize the movement of the rods 142 in and out of contact with the lowermost photoconductive section 20 (FIG. 1) in the stack 110 with the movement of the tamping assemblies 126 in and out of contact with the uppermost photoconductive section 20 in the stack 110.

In a copier 10 including the above described stacking apparatus, as each photoconductive section 20 (FIG. 1) is fed from the cleaning station 40 and enters the receptacle 112 via the inlet opening 120, one of the tamping assemblies 126 is slid upwardly and the other permitted to slide downwardly on the receptacle wall 114 with which it is associated. The upwardly sliding tamping assembly 126 is thereby raised out of contact with the stack 110 to permit the leading fold of an entering photoconductive section 20, and thus the trailing fold of the previously received photoconductive section 20, to be fed beneath the upwardly sliding tamping assembly 126. On the other hand, the downwardly sliding tamping assembly 126 is permitted to fall under the influence of gravity into contact with the leading fold of the previously received photoconductive section 20 to urge the latter, and thus the trailing fold of the next previously received photoconductive section 20, into contact with the top of the stack 110. Thereafter, the rocker arms 140 raise the tamping assembly 126 previously lowered to permit the next succeeding photoconductive section 20 to be fed therebeneath, and lower the tamping assembly 126 previously raised to permit the same to slide downwardly against the leading fold of the photoconductive section 20 then disposed therebeneath. Accordingly, th rocker arms 140 play an active role insofar as raising the tamping assemblies 126 is concerned, but play a passive role insofar as tamping the photoconductive sections 20 is place on top of the stack 110 is concerned. Of course, as each successive photoconductive section 20 enters the receptacle 112 for disposition on top of the stack 110, the photoconductive section 20 then disposed at the bottom of the stack 110 is pulled over the rods 142 and receptacle lips 124, and fed out of the receptacle 112 via the outlet opening 122 for disposition on top of the guide plate 28. Thus, as the supply of photoconductor sections 20 of the stack 110 is continuously depleted, the stack 110 is replenished.

As the photoconductive sections 20 (FIG. 1) are urged toward the receptacle outlet opening 122 by the tamping assemblies 126, they tend to resist having the opposite folds thereof progressively urged closer to the receptacle outlet opening 122 than the respective mid-portions thereof. The folds thus exert an upwardly directed force on the tamping assemblies 126 and follow the upward movement of the same, thereby preventing the tamping assemblies 126 from sliding as far down on the receptacle walls 114 as is permitted by the downwardly moving rocker arms 140. When the tamping assemblies 126 are thus disassociated from the rocker arms 140 they may become cocked in place on the receptacle walls 114 above the usual level of disposition of the topmost photoconductive section 20 in the stack 110. Or, after relatively few oscillations of the rocker arms 140, the tamping assemblies 126 may become supported by a few of the photoconductive sections 20 above the lowermost level to which the rocker arms 140 permit the same to fall; as a result of which the tamping asemblies 126 are no longer raised by the rocker arms 140 a sufficient distance to permit the tamping assemblies 126 to significantly tamp the photoconductive sections 20. In at least the latter case the tamping assemblies 126 may interfere with the passage of the folds of the incoming photoconductive sections 20 to the top of the stack 110 and/or permit the photoconductive sections 20 to become stacked on top of either or both of the tamping assemblies 126; as a result of which several of the photoconductive sections 20 may be repeatedly lowered against the mid-portion of the stack 110 or otherwise unevenly distributed over the top of the stack. Eventually, such shifts in the disposition of the weight of the photoconductive sections 20 within the receptacle 112 have resulted in the mid-portion of the stack 110 collapsing, mid-portion-first downwardly, toward the receptacle outlet opening 122.

Figure 4:
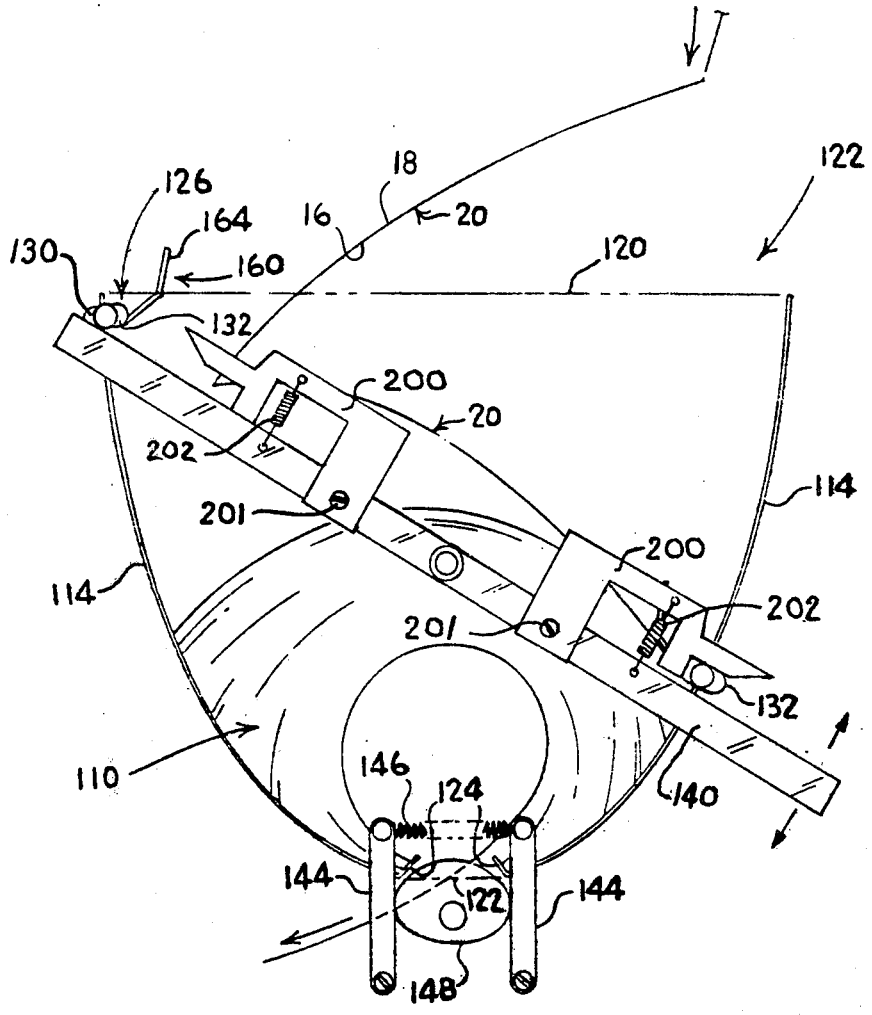

In accordance with the present invention, there are provided two pairs of carriers 200 (FIG. 4). Each of the carriers is substantially L-shaped. And, each of the carriers 200 of a given pair is spaced apart from the other and adapted for association with the opposite end caps 130 of a given tamping assembly 126. One of the legs of each of the carriers 200, of a given pair of carriers 200, is hinged at spaced points 201 to a given rocker arm 140. And the other leg is connected to the associated rocker arm 140 by means of a tension spring 202. Thus, each of the rocker arms 140 is associated with a pair of carriers 200, each of which is urged by a spring 202 toward the arm 140 associated therewith. In addition, the spring loaded leg of each of the carriers 200 forms, together with the associated rocker arm 140, a jaw which, during only a portion of the downward movement of the rocker arm 140 on the receptacle wall 114, slides over and engages the end cap 130 of the associated tamping bar assembly 126 and conveys the same toward the stack 110 under tension of the associated spring 202.

In accordance with the present invention, to cure this problem of damaging the photoconductive coating on the outer surface 18 of the respective photoconductive sections and thereby promote longevity of the photoconductor 14; there is provided a pair of spaced apart strips 160A and 160B (FIG. 4) of substantially L-shaped or straight cross-section. The strips 160A and 160B (FIG. 4) respectively include a single leg 162C for attachment of the strip to the tamping rod 128 and, the strips 160A and 160B (FIG. 4) are spaced apart from one another a distance such that they are disposed outside of the imaging plane of the photoconductor sections 20 so as to not degrade the portion of the photoconductive surface 18 of the same which is imaged at the imaging station 34 (FIG. 1).

In accordance with the objects of the invention there has been described an electrostatic copier including improved means for storing photoconductive sections in a zig-zag folded stack at the storage station of the copier.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a receptacle for a stack of zig-zag folded photoconductive web material having an imaging plane, conveying means for removing the web under traction via an outlet opening from the receptacle and for supplying the web material to an inlet opening of the receptacle, the receptacle having opposite guide walls arranged such that the stack is guided through the receptacle so as to cause the portions situated in closer proximity to the outlet opening than the inlet opening to form an arc which is concave-side oriented toward the outlet opening, whereby the stack is bowed, opposed tamping assemblies respectively movably mounted on opposite guide walls for contacting the folds of said web portions of the stack, and driving means for reciprocating the respective tamping assemblies along the guide walls, the improvement comprising: means for intermittently interconnecting the driving means and tamping assemblies, said interconnecting means including means for resiliently urging the tamping assemblies into sliding engagement with the guide walls.

2. The receptacle according to claim 1, wherein the driving means including two rocker arms, said interconnecting means including two carriers, one of said carriers being associated with each tamping assembly, each of said carriers being hinged to the rocker arm associated therewith, two springs associated with the respective carriers on a one for one basis, the spring associated with each carrier mounted to urge the same toward the associated rocker arm, one outer end of each of said carriers forming together with the rocker arm associated therewith a jaw which during downward movement of the relevant portion of the rocker arm toward the stack slides over the tamping assembly associated therewith and conveys the same toward the stack.

3. The receptacle according to claim 1, wherein each tamping means includes a rod, the driving means includes two rocker arms, and the interconnecting means including means for hinging the outer end of each tamping bar to one end of a tension spring, having the other end thereof hinged to the associated outer end of the relevant rocker arm.

4. The receptacle according to claim 1 wherein each tamping means includes a pair of spaced apart and substantially L-shaped guide strips, one leg of each of said strips projecting towards the inlet opening of the receptacle and partially over the stack, and said guide strips spaced apart from one another a distance such that they respectively contact the photoconductive material outside of the imaging plane thereof.

5. In a copier including a strip-type photoconductor having a plurality of photoconductive sections connected in series for folding on top of one another, each of said sections having an imaging plane, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening;

c. means for moving the respective tamping means out of step with one another toward and away from the stack including means for resiliently interconnecting the respective tamping means to the moving means so as to maintain each of the tamping means in movable engagement with the receptacle wall associated therewith during only a portion of the movement of the tamping means; and d. wherein the photoconductive sections each having a leading and trailing fold as fed to the receptacle, the tamping means respectively including a pair of strips, each of said strips of a given pair being spaced apart from the other a predetermined distance, said strips respectively having a substantially L-shaped transverse cross-section, and one of the legs of each of the strips protruding towards the receptacle inlet opening and partially over the stack for deflecting the leading and trailing folds toward the stack, without contacting the imaging plane of the respective photoconductive sections.

6. In a copier including a strip-type photoconductor having a plurality of photoconductive sections connected in series for folding on top of one another, each of said sections having an imaging plane, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening;

c. means for moving the respective tamping means out of step with one another toward and away from the stack including means for resiliently interconnecting the respective tamping means to the moving means so as to maintain each of the tamping means in movable engagement with the receptacle wall associated therewith during only a portion of the movement of the tamping means; and d. wherein the moving means engages the respective tamping means during only a portion of the movement thereof, and the moving means including carrier means adapted to slidably engage the respective tamping means and hold the same in sliding engagement therewith during movement of the tamping means.

7. In a copier including a strip-type photoconductor having a plurality of photoconductive sections connected in series for folding on top of one another, each of said sections having an imaging plane, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening;

c. means for moving the respective tamping means out of step with one another toward and away from the stack including means for resiliently interconnecting the respective tamping means to the moving means so as to maintain each of the tamping means in movable engagement with the receptacle wall associated therewith during only a portion of the movement of the tamping means; and d. wherein the tamping means respectively slidably engage the receptacle wall associated therewith for movement thereon toward and away from the stack, and the means for resiliently interconnecting the moving means to the respective tamping means including a plurality of carriers and a plurality of elongated springs, said carriers respectively adapted to override an end one of said tamping means and become slidably engaged therewith, said springs associated with said carriers on a one for one basis, and each of said springs adapted to maintain the associated carrier in engagement with the tamping means associated therewith.

8. In a copier including a strip-type photoconductor having a plurality of photoconductive sections connected in series for folding on top of one another, each of said sections having an imaging plane, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening;

c. means for moving the respective tamping means out of step with one another toward and away from the stack including means for resiliently interconnecting the respective tamping means to the moving means so as to maintain each of the tamping means in movable engagement with the receptacle wall associated therewith during only a portion of the movement of the tamping means; and d. wherein the tamping means respectively include a pair of substantially L-shaped strips for guiding the incoming photoconductive sections to the stack, and the moving means including a plurality of carriers and a plurality of pre-stressed tension springs, said carriers and springs associated with one another on a one for one basis, each of said springs arranged for resiliently holding the associated carrier in contact with one of the ends of one of the respective tamping means for movement thereof.

9. In a copier including a strip-type photoconductor having a plurality of photoconductive sections connected in series for folding on top of one another, each of said sections having an imaging plane, and means for serially feeding the photoconductive sections to and from a storage station, apparatus for storing the photoconductive sections in a zig-zag folded stack at the storage station comprising:

a. a receptacle having an inlet opening and an outlet opening through which the photoconductive sections are respectively fed to and from the stack, said receptacle including a pair of oppositely spaced walls extending relatively convergently towards one another for guiding the folds of the respective photoconductive sections progressively closer to the outlet opening than the mid-portions thereof in transit through the receptacle;

b. a pair of tamping means respectively movably engaging opposite receptacle walls and cooperating therewith for guiding photoconductive sections toward the outlet opening;

c. means for moving the respective tamping means out of step with one another toward and away from the stack including means for resiliently interconnecting the respective tamping means to the moving means so as to maintain each of the tamping means in movable engagement with the receptacle wall associated therewith during only a portion of the movement of the tamping means; and d. wherein the means for moving the respective tamping means includes a pair of rocker arms, the means for resiliently interconnecting the moving means to the tamping means includes two pairs of carriers, a pair of said carriers being pivotably attached to each of the rocker arms, the carriers attached to a given rocker arm being respectively associated with opposite tamping means, a plurality of tension springs, the carriers and springs associated with one another on a one for one basis, each spring interconnecting the associated carrier to the associated rocker arm, and each carrier adapted to slidably engage the tamping means associated therewith for urging the tamping means into sliding engagement with the receptacle wall associated therewith.

* * * * *